US012383809B2

(12) United States Patent
Peacock

(10) Patent No.: US 12,383,809 B2
(45) Date of Patent: Aug. 12, 2025

(54) SPINNER AND FLOOR GAME AND METHOD

(71) Applicant: Dennis Earl Peacock, Raleigh, NC (US)

(72) Inventor: Dennis Earl Peacock, Raleigh, NC (US)

( * ) Notice: Subject to any disclaimer, the term of this patent is extended or adjusted under 35 U.S.C. 154(b) by 643 days.

(21) Appl. No.: 17/664,675

(22) Filed: May 24, 2022

(65) Prior Publication Data

US 2023/0381618 A1 Nov. 30, 2023

(51) Int. Cl.
*A63B 67/00* (2006.01)
*A63B 71/04* (2006.01)

(52) U.S. Cl.
CPC ..... *A63B 67/00* (2013.01); *A63B 71/04* (2013.01)

(58) Field of Classification Search
CPC ..... A63B 67/00; A63B 71/04; A63F 9/00
See application file for complete search history.

(56) References Cited

U.S. PATENT DOCUMENTS 3,454,279 A * 7/1969 Rabens ..... A63B 67/00 273/444
3,484,106 A * 12/1969 Foley ..... A63F 9/00 273/444
3,879,034 A * 4/1975 Petrusek ..... A63B 67/00 273/444
3,891,209 A * 6/1975 Kritzberg ..... A61B 5/16 273/459
4,039,186 A 8/1977 Anderson
5,156,409 A * 10/1992 Barnes ..... A63B 5/22 273/444
5,507,495 A 4/1996 Kiss
5,839,976 A 11/1998 Darr
6,086,378 A 7/2000 Johnson
6,254,101 B1 7/2001 Young
6,620,063 B1 9/2003 Benjamin
7,481,726 B2 1/2009 Hawk
9,047,786 B2 6/2015 MaLossi et al.
9,984,536 B2 5/2018 Weingardt et al.
2005/0073105 A1* 4/2005 Given ..... A63B 67/00 273/449
2006/0194651 A1* 8/2006 Hawk ..... A63B 67/00 473/414
2010/0025930 A1 2/2010 Rank et al.
2013/0069312 A1 3/2013 Letchford et al.
2013/0295530 A1 11/2013 Townsend et al.
2014/0127648 A1 5/2014 Green
2015/0133239 A1 5/2015 Curtis

* cited by examiner

*Primary Examiner* — Raleigh W Chiu
(74) *Attorney, Agent, or Firm* — Dunlap Bennett & Ludwig, PLLC

(57) ABSTRACT

A game apparatus and method of playing a game are disclosed herein. The game includes a game floor mat and a spinner device. The game floor mat includes a start line, a finish line, and differently colored lanes arranged in in parallel and interposed between the start line and the finish line, with each lane comprising a predetermined number of step spaces. The spinner device includes differently colored wedges that correspond to the differently colored lanes, with each wedge including a step instruction defined thereon and a spinner pointer designed to be spun, which results in the spinner pointer landing on one of the wedges. The selected wedge identifies the lane in which the corresponding player should move, and how many steps that player should take.

11 Claims, 3 Drawing Sheets

SPINNER AND FLOOR GAME AND METHOD

BACKGROUND OF THE INVENTION

The present invention relates to recreational game equipment and a method of playing a game associated with said game equipment, and more particularly a game that involves physical activity for a plurality of players Games provide entertainment fun at parties or any social gathering. Conventional games do not allow for physical interaction for all ages. Existing games either require a player to have a prerequisite level of physical strength or size, or they are too simple to play and/or boring that does not encourage participation during turns.

As can be seen, there is a need for a floor game that permits participation for all age groups that is also entertaining to play.

SUMMARY OF THE INVENTION

In one aspect of the present invention, a game apparatus wherein a plurality of players move according to predetermined rules of movement is disclosed, with the game apparatus comprising: a game floor mat comprising a start line, a finish line, and a plurality of differently colored lanes arranged in parallel and interposed between the start line and the finish line, with each lane comprising a plurality of step spaces; and a spinner device comprising: a plurality of differently colored wedges that correspond to the plurality of differently colored lanes, with each wedge comprising a step instruction defined thereon; and a spinner pointer configured to be spun which results in the spinner pointer landing on one of the wedges.

In another aspect of the present invention, a method of playing a game wherein a plurality of players move according to predetermined rules of movement is disclosed, with the method comprising the steps of: providing a game floor mat comprising a start line, a finish line, and a plurality of differently colored lanes arranged in in parallel and interposed between the start line and the finish line, with each lane comprising a plurality of step spaces; providing a spinner device comprising: a plurality of differently colored wedges that correspond to the plurality of differently colored lanes, with each wedge comprising a step instruction defined thereon; and a spinner pointer; and spinning the spinner pointer, which results in the spinner pointer landing on one of the wedges.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
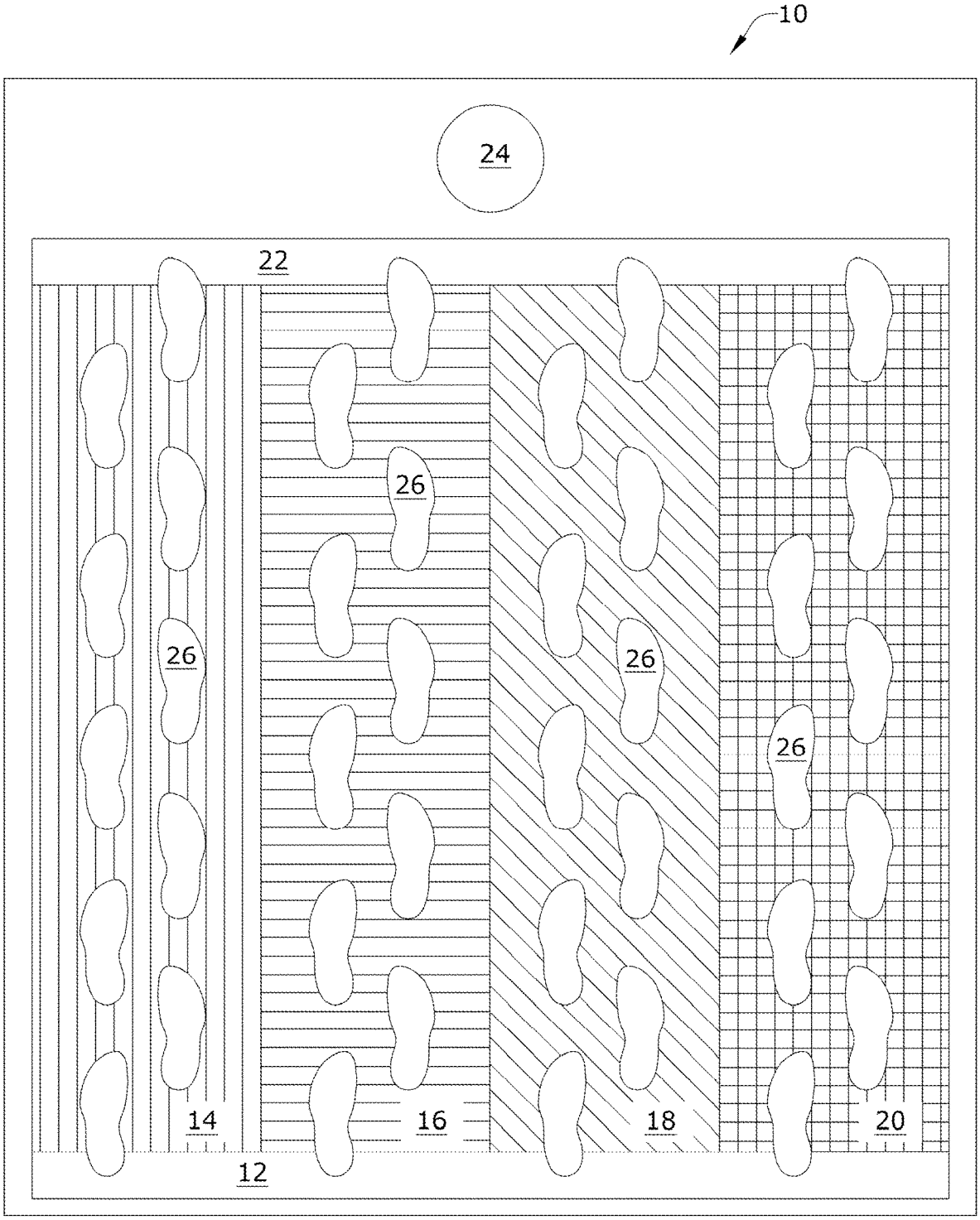
FIG. 1 is a schematic view of a floor mat of an embodiment of the present invention.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details. For the purpose of clarity, technical material that is known in the technical fields related to the present invention has not been described in detail so that the present invention is not unnecessarily obscured Broadly, an embodiment of the present invention provides a spinner game that includes a game mat and a spinner. The game mat generally includes: (1) a plurality of colored columns/lanes, each colored column/lane comprising a different color and a plurality of indicia configured to be stepped on by a player; (2) a start line at a first end of the game mat; and (3) a finish line at a second end of the game mat. The game spinner generally includes: (1) a plurality of wedges corresponding to respective different colors of the columns/lanes on the game mat; and (2) a spin pointer configured to be spun and land on a respective wedge of the plurality of wedges.

According to certain aspects of the present invention, participants compete to win a prize provided by the host. In order to do so, participants must according to a provided turn along a specified path according to predetermined rules of movement to reach the prize. More specifically, each participant moves along a colored path on a game mat. The participants may dance and move to music while waiting for their turn to move. In order to practice the present invention, a game spinner and game mat are necessary for play. Game music may be optionally provided, but it adds more excitement to the presently described spinner game.

Making reference to FIG. 1, a game floor mat 10 is provided. The mat 10 includes a start line 12, a plurality of differently colored columns/lane 14, 16, 18, 20, a finish line 22, and a prize circle 24. By way of example, a first lane 14 may be red in color, a second lane 16 may be blue in color, a third lane 18 may be green in color, and a fourth lane 20 may be yellow in color. However, those with skill in the art will appreciate that any color or other manner of differentiating the lanes may be employed such that they are visually distinctive from one another. The lanes 14 are arranged in parallel and stacked adjacent one another, serving as color coded paths for each player to move along. Each lane 14 includes a plurality of step spaces 26 (in the form of a foot) that the player must step/walk on sequentially to move along a respective lane, with the players all starting at the start line 12. In certain embodiments, ten step spaces 26 along each lane for a user to travel over the course of the game. The prize circle 24 is a predetermined location to display the prize to attract new and motivate current game participants. When the game is being played, the first participant to cross the finish line 22 and reach the prize circle 24 wins the associated game or prize.

Figure 2:
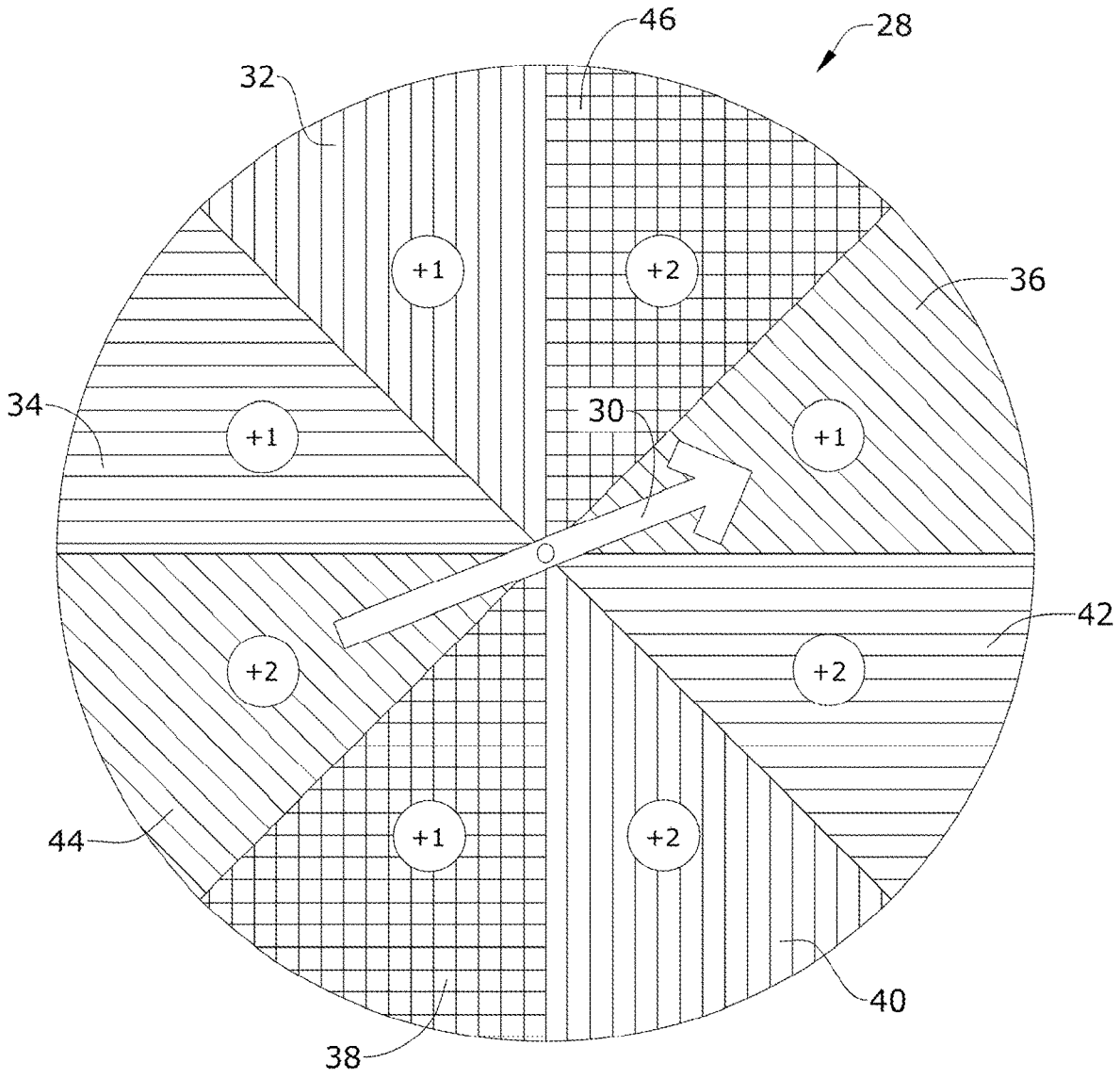
FIG. 2 is a schematic view of a spin wheel of the embodiment of the present invention.
Figure 3:
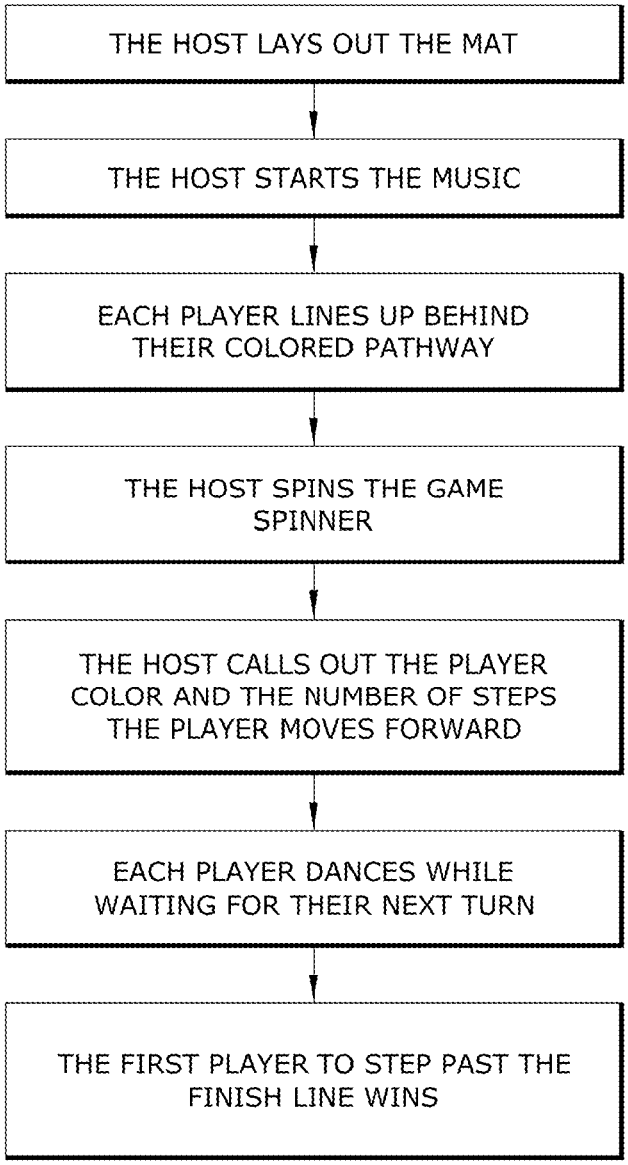
FIG. 3 is a flow chart of the embodiment of the present invention.

As shown in FIG. 2, a game spinner 10 is provided with a spin pointer 30 and a plurality of wedges 32, 34, 36, 38, 40, 42, 44, 46. The wedges are colored (or otherwise clearly marked) to correspond to the lanes on the game mat 10. The game spinner 28 dictates movement of the players on the mat 10 based upon where the pointer 30 lands. FIG. 2 illustrates an exemplary layout of such a spinner 28, but other configurations, of course, may be employed. By way of example, a first wedge 32 corresponds to the first lane 14, and the "+1" indicates that the player associated with the first lane 14 should take a single step forward, one foot at a time, on the step spaces 26 (when the pointer 30 lands on the first wedge 32). In a similar manner, there are provided a second wedge 34 (corresponding to the second lane 16 and a single step forward), a third wedge 36 (corresponding to the third lane 18 and a single step forward), a fourth wedge 38 (corresponding to the fourth lane 20 and a single step forward), a fifth wedge 40 (corresponding to the first lane 14 and two steps forward), a sixth wedge 42 (corresponding to the second lane 16 and a two steps forward), a seventh wedge 44 (corresponding to the third lane 18 and two steps forward), and an eighth wedge 46 (corresponding to the fourth lane 20 and two steps forward).

In order to play the game, players/participants select and stand behind a color-coded lane 14, 16, 18, 20. Then, a host or other individual spins the game spinner 28 to direct the players to move accordingly. Players move when the game spin pointer 30 lands on one of their colored wedges, and they move a corresponding number of steps as indicated on the wedge. Music may be played through a boom box or blue tooth speaker provided by host to provide a more fun atmosphere.

More specifically, a method of using the present invention may include the following. First, a host (or guest at a gathering) finds a clear floor space, for example, at least eight feet by twelve feet. The host (or guest at the gathering) then rolls out game mat and gets a plurality of players (for example, four) to line up behind a respective colored path/lane at the start line. The host (or guest at the gathering) then spins the game spinner. Once the game spinner pointer lands on a particular wedge including a color and number of steps, the host calls out the landed upon player color and number of steps. Once that has occurred, the player whose lane has been called out moves the required steps along the step spaces provided on the game mat towards the finish line. This process is repeated until a player reaches the finish line (e.g., which occurs when the player steps on the tenth step on the game mat, which overlaps with the finish line). The play who makes it to the finish line wins the game/the prize (which, as mentioned, may be disposed in the prize circle). Players may dance and move to the music while waiting to see if the spinning pointer lands on their color.

In accordance with certain aspects of the present invention, instead of a game spinner, an individual may also use color-coded numbers or balls to move the players participating in the game. The game mat may also use blocks (or other appropriate shapes) to move along instead of footprints. In other embodiments, a systemic software application with a display device may alternatively be used to randomly select which player moves, with a colored light that flashes on a screen along with a number of steps underneath the color. When the player's light flashes, he or she moves the number of steps under the colored light.

A method of making the present invention may include the following. The game mat may be formed from plastic or a cloth material. It may be sewn or fused. However the mat is formed, it should be light and flexible with different colors for step movements along the paths, and further provided with a start line and a finish line. The gamer spinner may be formed from molded plastic or any other appropriate material.

While one or more preferred embodiments are disclosed, many other implementations will occur to one of ordinary skill in the art and are all within the scope of the invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

While apparatuses and methods are described in terms of "comprising," "containing," or "including" various components or steps, the apparatuses and methods can also "consist essentially of" or "consist of" the various components and steps. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A game apparatus wherein a plurality of players move according to predetermined rules of movement, the game apparatus comprising:

a game floor mat comprising a start line, a finish line, and a plurality of differently colored lanes arranged in parallel and interposed between the start line and the finish line, with each lane comprising a plurality of step spaces, wherein a first step space in each lane overlaps with the lane and the start line, and a final step space in each lane overlaps with the lane and the finish line; and a spinner device comprising:

a plurality of differently colored wedges that correspond to the plurality of differently colored lanes, with each wedge comprising a step instruction defined thereon; and a spinner pointer configured to be spun which results in the spinner pointer landing on one of the wedges.

2. The game apparatus of claim 1, wherein the step spaces are formed in the shape of a foot.

3. The game apparatus of claim 1, wherein the game floor mat further comprises a prize circle disposed beyond the finish line.

4. The game apparatus of claim 1, wherein each step instruction comprises an indicia configured to direct one of the plurality of players to take either one or two steps along the plurality of step spaces in the lane associated with the one of the plurality of players.

5. A game apparatus wherein a plurality of players move according to predetermined rules of movement, the game apparatus comprising:

a game floor mat comprising a start line, a finish line, and a plurality of differently colored lanes arranged in parallel and interposed between the start line and the finish line, with each lane comprising a plurality of step spaces, wherein the game floor mat further comprises a prize circle disposed beyond the finish line; and a spinner device comprising:

a plurality of differently colored wedges that correspond to the plurality of differently colored lanes, with each wedge comprising a step instruction defined thereon; and a spinner pointer configured to be spun which results in the spinner pointer landing on one of the wedges.

6. The game apparatus of claim 5, wherein the step spaces are formed in the shape of a foot.

7. Game apparatus of claim 5, wherein each step instruction comprises an indicia configured to direct one of the plurality of players to take either one or two steps along the plurality of step spaces in the lane associated with the one of the plurality of players.

8. A method of playing a game wherein a plurality of players move according to predetermined rules of movement, the method comprising the steps of:

providing a game floor mat comprising a start line, a finish line, and a plurality of differently colored lanes arranged in parallel and interposed between the start line and the finish line, with each lane comprising a plurality of step spaces, wherein a first step space in each lane overlaps with the lane and the start line, and a final step space in each lane overlaps with the lane and the finish line;

providing a spinner device comprising:

a plurality of differently colored wedges that correspond to the plurality of differently colored lanes, with each wedge comprising a step instruction defined thereon; and a spinner pointer; and spinning the spinner pointer, which results in the spinner pointer landing on one of the wedges.

9. The method of claim 8, the method further comprising the step of: requiring each player to place one of their feet on a respective first step space of a respective lane associated with the player.

10. The method of claim 9, the method further comprising the step of: requiring one player to take one or two steps along the plurality of step spaces based on the landing of the spinner pointer on one of the wedges.

11. The method of claim 10, the method further comprising the step of: repeating the requiring one player to take one or two steps along the plurality of step spaces step until a player reaches the finish line.

* * * * *